US006651910B2

(12) United States Patent
Elliott-Moore

(10) Patent No.: US 6,651,910 B2
(45) Date of Patent: Nov. 25, 2003

(54) HIGH PRESSURE WATER CONTROL DEVICE

(75) Inventor: Peter Elliott-Moore, Worcester (GB)

(73) Assignee: Calder Limited, Worcester (GB)

( * ) Notice: Subject to any disclaimer, the term of this patent is extended or adjusted under 35 U.S.C. 154(b) by 0 days.

(21) Appl. No.: 10/298,044

(22) Filed: Nov. 18, 2002

(65) Prior Publication Data

US 2003/0094512 A1 May 22, 2003

(30) Foreign Application Priority Data

Nov. 16, 2001 (GB) ..... 0127476

(51) Int. Cl.[7] ..... A62C 31/00; B05B 9/01

(52) U.S. Cl. ..... 239/436; 239/440; 239/441; 239/442; 239/443; 239/446; 239/447; 239/448; 239/525; 239/526; 137/882

(58) Field of Search ..... 239/124, 436, 239/440, 441, 442, 443, 444, 446, 447, 448, 449, 525, 526, 527, 569, 583; 137/882, 881

(56) References Cited

U.S. PATENT DOCUMENTS

| | | | | | |
|---|---|---|---|---|---|
| 555,062 | A | * | 2/1896 | Murphy | 239/441 |
| 618,412 | A | * | 1/1899 | Haas et al. | 239/441 |
| 2,567,176 | A | * | 9/1951 | Ballard | 239/449 |
| 2,635,010 | A | * | 4/1953 | Sanders et al. | 239/526 |
| 3,822,724 | A | * | 7/1974 | Clapp et al. | 137/882 |
| 3,930,616 | A | | 1/1976 | Winter | |
| 4,530,469 | A | * | 7/1985 | Muck | 239/569 |
| 4,541,568 | A | | 9/1985 | Lichfield | |
| 4,665,944 | A | * | 5/1987 | Wallace et al. | 239/124 |
| 4,784,330 | A | | 11/1988 | Hammelmann | |
| 5,297,777 | A | | 3/1994 | Yie | |
| 5,349,982 | A | * | 9/1994 | Goldsmith | 137/882 |
| 5,423,348 | A | * | 6/1995 | Jezek et al. | 239/526 |
| 5,524,821 | A | | 6/1996 | Yie et al. | |
| 5,794,854 | A | | 8/1998 | Yie | |
| 5,975,429 | A | * | 11/1999 | Jezek | 137/882 |

FOREIGN PATENT DOCUMENTS

| | | |
|---|---|---|
| DE | 31 24 125 A1 | 1/1983 |
| EP | 0 273 677 A2 | 7/1988 |
| GB | 2 049 883 A | 12/1980 |
| GB | 2 204 664 A | 11/1988 |
| JP | A 8-24728 | 1/1996 |
| JP | A 9-85192 | 3/1997 |

* cited by examiner

*Primary Examiner*—Robin O. Evans
(74) *Attorney, Agent, or Firm*—Young & Thompson

(57) ABSTRACT

A high pressure water control device comprising a water inlet, a high pressure water outlet, a low pressure water outlet and a valve for selectively communicating the inlet with one or other of the outlets. The valve is a spool valve comprising a sleeve and a spool slidable in the sleeve. The spool has two axially spaced apart annular seals and the sleeve includes an annular groove in its outer surface and one or more dump ports which communicate between the groove and the inside of the sleeve so that when the dump ports are disposed between the spaced apart seals of the spool high pressure water will be delivered to the high pressure water outlet. The control device is in the form of a water gun having an elongate nozzle terminating in the high pressure outlet and a barrel surrounding the nozzle and terminating in the low pressure outlet.

14 Claims, 3 Drawing Sheets

FIG 3
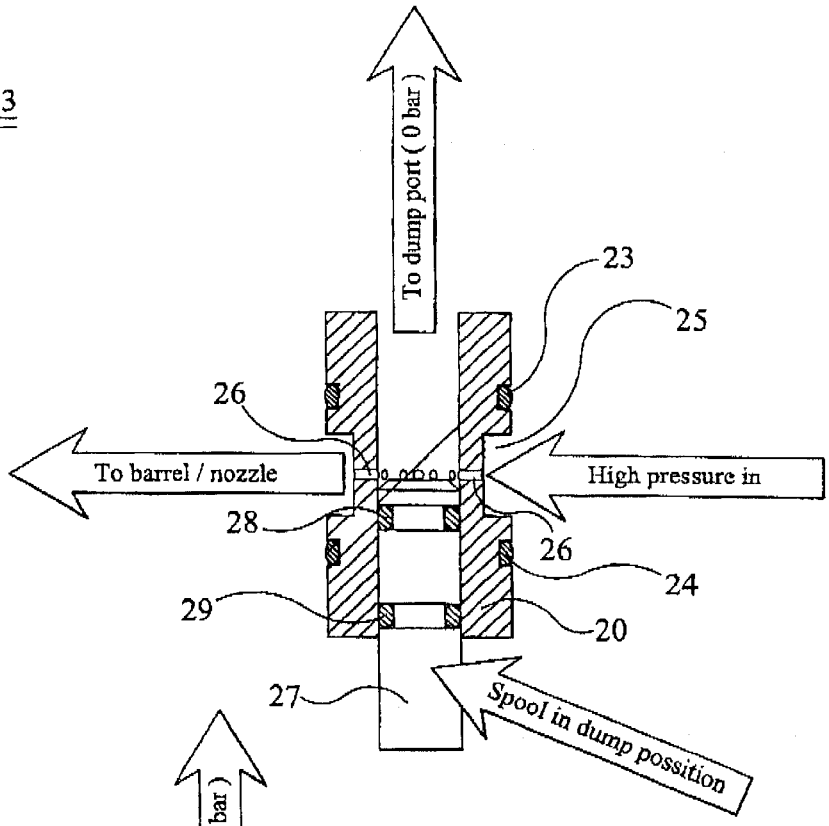
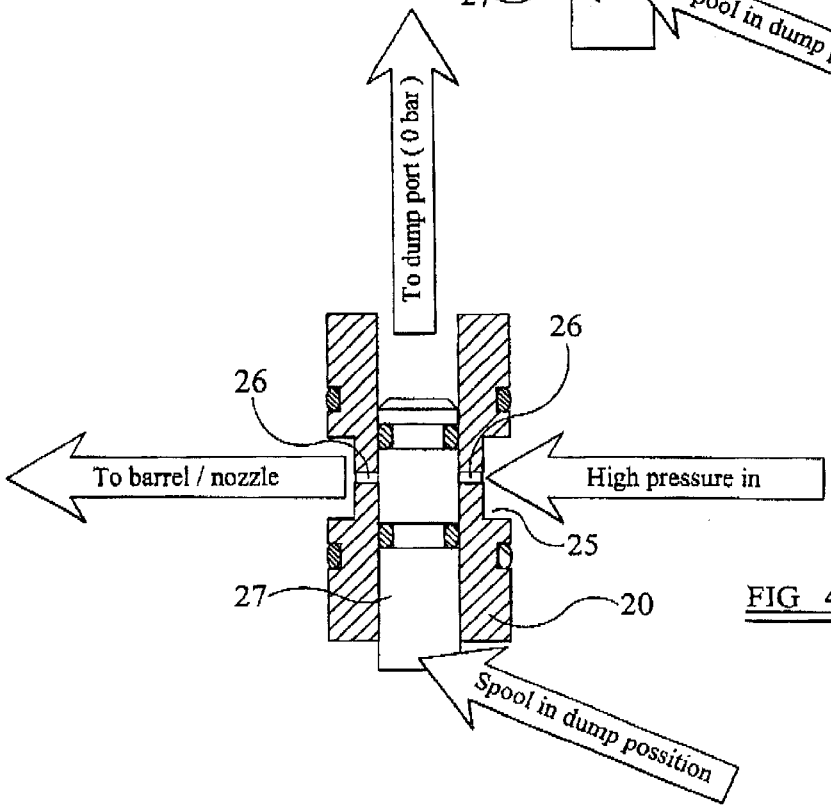
FIG 4

HIGH PRESSURE WATER CONTROL DEVICE

INTRODUCTION

This invention relates to a high pressure water control device such as a dump gun for firing high pressure water to break up concrete.

Known dump guns commonly include poppet valves to control the flow of water between a high pressure nozzle and dump. The water can be dumped at low pressure to the surroundings or returned to a water reservoir.

Poppet valves cannot guarantee pressure balance as cone and seat diameters are subject to tolerances and change/wear during use. Also, poppet valves rely on the operator's hand force to maintain the seal. If this force is relaxed leakage will occur without the operator being aware of any handle movement. This type of leakage leads to very rapid valve/seat erosion failure. Furthermore, poppet valves are very sensitive to erosion failure. This normally results in the seat and cone being scrapped. Erosion failure at high pressures is rapid, unpredictable and almost impossible to avoid.

The invention seeks to overcome or mitigate these drawbacks.

SUMMARY OF THE INVENTION

According to one aspect of the present invention, there is provided a high pressure water control device comprising a water inlet, a high pressure water outlet, a low pressure water outlet and a valve for selectively communicating the inlet with one or other of the outlets, wherein the valve is a spool valve.

According to another aspect of the invention there is provided a high pressure water control device in the form of a high pressure water gun comprising a water inlet, a high pressure water outlet, a low pressure water outlet, a spool valve for selectively communicating the inlet with one or other of the outlets, an elongate nozzle terminating in said high pressure outlet and a barrel surrounding the nozzle and terminating in said low pressure outlet.

The invention will now be more particularly described, by way of example, with reference to the accompanying drawings.

DESCRIPTION OF THE PREFERRED EMBODIMENT

Figure 1:
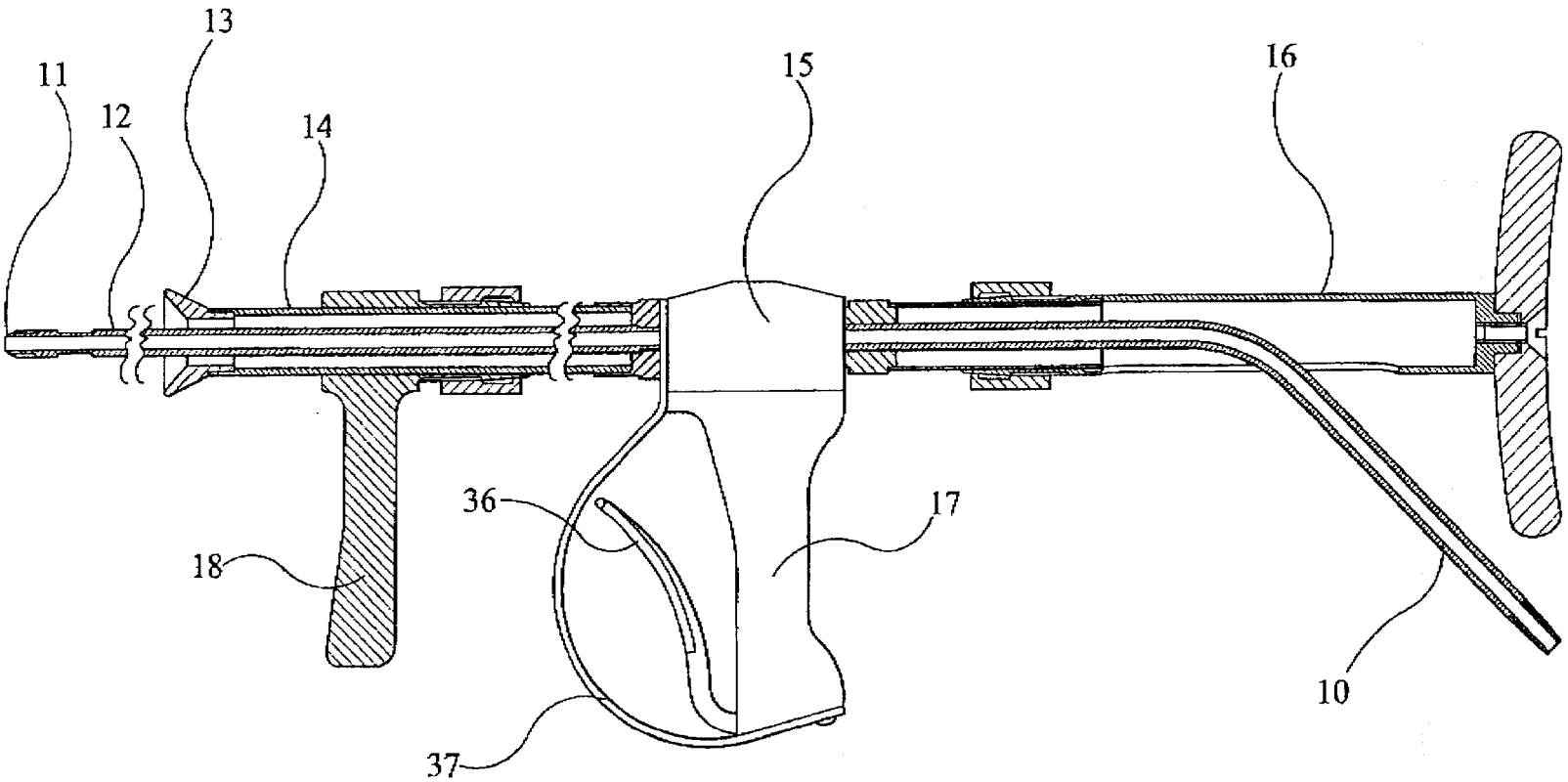
FIG. 1 is a sectional view of one embodiment of a high pressure water control device according to the invention.

Referring to the drawings, the high pressure water control device shown therein is in the form of a dump gun for firing high pressure water to break up concrete.

The gun comprises a high pressure water inlet in the form of a tube 10 which can be connected to a source of high pressure water, typically at 1,000 to 3,000 bar, a high pressure water outlet 11 at the remote end of an elongate nozzle 12 and a low pressure water outlet 13 at the remote end of a barrel 14 which surrounds the nozzle 12.

The gun also comprises a housing 15 to which the nozzle 12 and barrel 14 are attached and to which the inlet tube 10 is also attached. A telescopically adjustable shoulder rest 16 is also attached to the housing 15.

The gun also has two handles 17 and 18. The handle 17 is slidably attached to the housing 15 and the handle 18 is mounted on the barrel 14 so that its position can be adjusted relative to the handle 17 by sliding it along the barrel 14 and then releasably fixing it in place.

Figure 2:
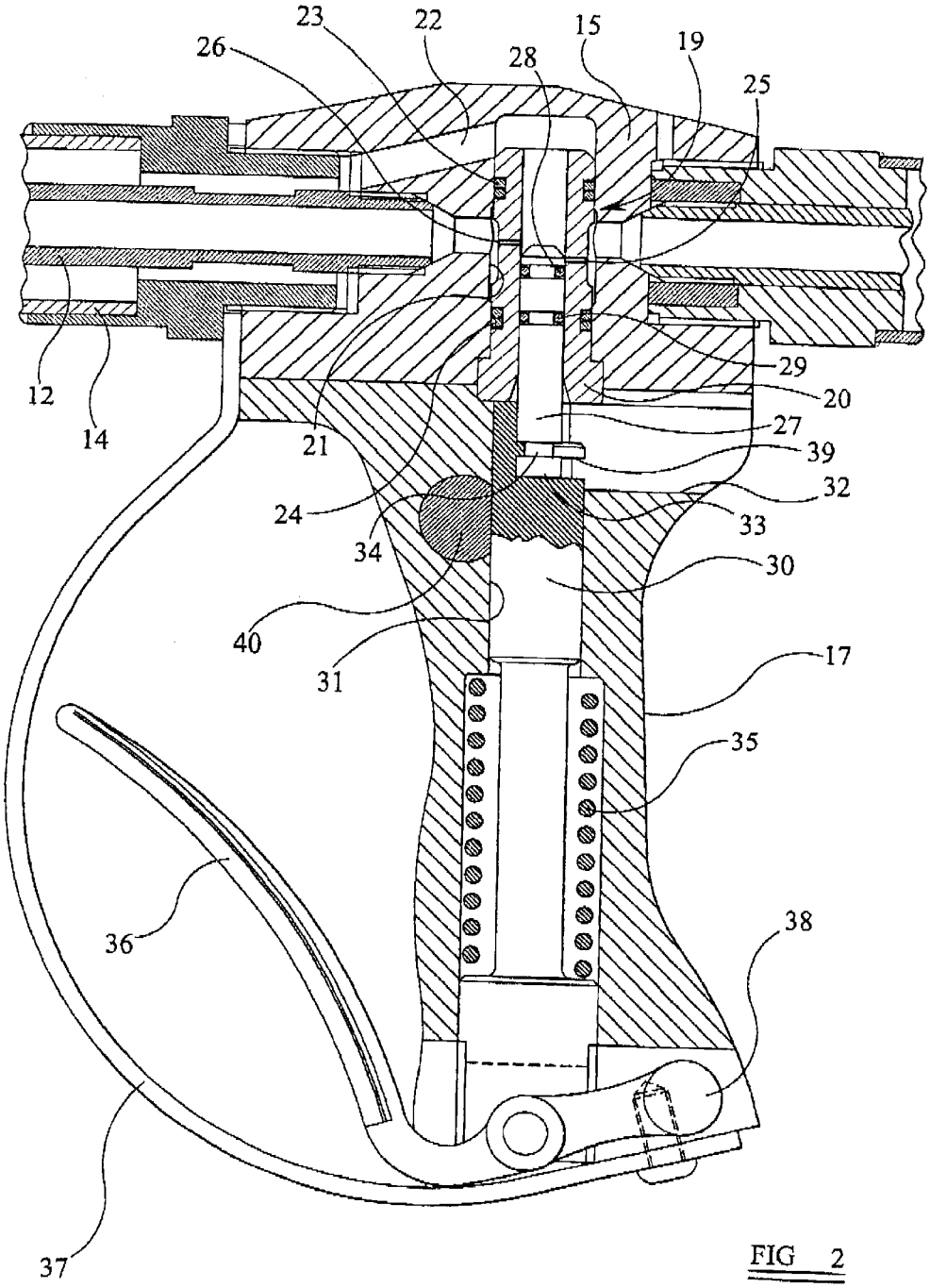
FIG. 2 is a fragmentary sectional view of part of the control device shown in FIG. 1, and FIGS. 3 and 4 are diagrammatic views showing the spool of the spool valve of the control device in two different positions.

The housing 15 supports a spool valve 19 which is best shown in FIGS. 2 to 4.

The spool valve 19 comprises a sleeve 20 mounted in a bore 21 in the housing 15. The sleeve 20 is fixed in place in the bore 21 by the removable handle 17. The sleeve 20 terminates short of the inner (or upper) end of the bore 21 and the space between the sleeve 20 and the inner (or upper) end of the bore 21 communicates with the barrel 14 via a passage 22 in the housing 15.

The sleeve 20 has two axially spaced annular seals 23, 24 each of which may comprise two different sealing elements. Intermediate the seals 23 and 24, the sleeve 20 has an annular groove 25 in its outer surface and at least one, but, as shown, a plurality of dump ports 26 which communicate between the groove 25 and the interior of the sleeve 20.

The spool valve 19 also comprises a spool 27 slidable in the sleeve 20. The spool 27 has two axially spaced annular seals 28 and 29.

When the dump ports 26 are disposed between the spaced apart seals 28 and 29 of spool 27, as shown in FIG. 4, high pressure water will be delivered to the high pressure water outlet 11 via the groove 25 and the nozzle 12.

When the spool 27 is in a fully retracted position as shown in FIGS. 1, 2 and 3, the dump ports 26 will communicate with the low pressure outlet 13 via the interior of the sleeve 20, passage 22 and the barrel 14 to dump water to the surroundings at low pressure.

The spool 27 is connected to a plunger 30 which is slidably mounted in a bore 31 of the handle 17. The handle has a slot 32 and the spool 27 has a head 33 and neck 34 so that the head 33 can be slidably received in a transverse slot 39 in the upper end of the plunger 30. This allows the handle 17, together with the plunger 30, to be removed from the housing 15 to enable the sleeve 20 and/or spool 27 to be easily replaced.

The plunger 30 is urged downwards by a compression spring 35 and a trigger element 36 is pivotably connected to the lower end of the plunger 30.

A trigger guard 37 is attached between the housing 15 and the handle 17 and a rear end portion 38 of the trigger element reacts against the guard 37 when the trigger is manually compressed towards the handle 17 to urge the plunger 30 and spool 27 upwards against the urging force of the spring 35. Thus, if the guard 37 is not in place the spool 27 cannot be moved from the position shown in FIGS. 1, 2 and 3 in which position low pressure water entering the inlet tube 10 is dumped via the low pressure outlet 13.

The trigger element 36 is also provided with a safety lock in the form of a depressible button 40 which can be moved from a locked position as shown in FIG. 2 in which it locks the trigger element in an inoperative position to an unlocked position in which it clears the plunger 30 to allow the trigger element 36 to pivot.

The use of a spool valve over a poppet valve has many advantages. Spool valves have perfect pressure balance by virtue of the parallel spool. Also, they have built in over travel which makes them insensitive to operator handle force (i.e. the handle has to move a considerable distance prior to reaching a leakage point). Spool valves are insensitive to erosion as there is no seat/cone. Final failure is normally due to wear of the working seals. Failure is consistent, predictable, and normally only requires the seals to be replaced. Spool valves are simple to manufacture with few critical dimensions. This enables the part to be manufactured in relatively exotic materials such as tungsten carbide without incurring huge cost penalties.

The embodiment described above is given by way of example only and various modifications will be apparent to persons skilled in the art without departing from the scope of the invention as defined by the appended claims. For example, the spool could be operated pneumatically rather than manually.

What is claimed is:

1. A high pressure water control device comprising a water inlet, a high pressure water outlet, a low pressure water outlet and a spool valve for selectively communicating the inlet with one or other of the outlets, wherein the spool valve comprises a sleeve and a spool slidable in the sleeve and wherein the spool has two axially spaced apart annular seals and the sleeve includes an annular groove in its outer surface and one or more dump ports which communicate between the groove and the inside of the sleeve so that when the dump ports are disposed between the spaced apart seals of the spool high pressure water will be delivered to the high pressure water outlet.

2. A control device as claimed in claim 1 in the form of a high pressure water gun.

3. A control device as claimed in claim 2, wherein the gun has an elongate nozzle terminating in said high pressure outlet and a barrel surrounding the nozzle and terminating in said low pressure outlet.

4. A control device as claimed in claim 3, wherein the valve is a manually operable valve.

5. A control device as claimed in claim 3, wherein the gun has two spaced apart handles and the nozzle and the barrel extend beyond the space between the two handles.

6. A control device as claimed in claim 4, wherein the spool valve is operated by a pivotable trigger element.

7. A control device as claimed in claim 6, wherein the trigger element has a safety lock.

8. A control device as claimed in claim 6, wherein the trigger element is provided with a trigger guard and the trigger element reacts against the guard so as not to operate the spool valve unless the guard is in place.

9. A control device as claimed in claim 8, wherein the trigger element is pivotably connected to a slidable plunger which is in turn connected to the spool so that the trigger element can move the spool in opposite directions.

10. A control device as claimed in claim 8, wherein the trigger element has a safety lock.

11. A control device as claimed in claim 9, wherein the trigger element has a safety lock.

12. A high pressure water control device in the form of a high pressure water gun comprising a water inlet, a high pressure water outlet, a low pressure water outlet, a spool valve for selectively communicating the inlet with one or other of the outlets, an elongate nozzle terminating in said high pressure outlet and a barrel surrounding the nozzle and terminating in said low pressure outlet.

13. A control device as claimed in claim 12, wherein the gun has two spaced apart handles and the nozzle and the barrel extend beyond the space between the two handles.

14. A control device as claimed in claim 12, wherein the valve is a manually operable valve.

* * * * *